United States Patent [19]

Schultheiss

[11] 4,122,925

[45] Oct. 31, 1978

[54] COMBINED SUITCASE AND BRIEFCASE

[75] Inventor: Udo F. Schultheiss, Shramberg, Germany

[73] Assignee: Hans R. Mittemeijer, Winston-Salem, N.C.

[21] Appl. No.: 865,505

[22] Filed: Dec. 29, 1977

[51] Int. Cl.[2] ..... A45C 3/00

[52] U.S. Cl. ..... 190/52; 190/60

[58] Field of Search ..... 190/52, 60; 150/34; 215/6; 224/45 R, 45 Q, 46 R, 47; 220/23.4, 23.83, 23.86

[56] References Cited

U.S. PATENT DOCUMENTS

| | | | |
|---|---|---|---|
| 2,428,906 | 10/1947 | Cannella | 224/45 R |
| 2,707,035 | 4/1955 | Lashley | 190/52 |
| 3,225,951 | 12/1965 | Poston | 215/6 |
| 3,319,744 | 5/1967 | Smith | 190/60 X |
| 3,696,850 | 10/1972 | Rosenblum | 190/52 |
| 3,958,731 | 5/1976 | Riedle | 190/60 X |

*Primary Examiner*—Donald F. Norton

*Attorney, Agent, or Firm*—Clarence A. O'Brien; Harvey B. Jacobson

[57] ABSTRACT

A travelling case for containing personal articles and the like and having a recess formed in a peripheral side wall adapted to receive an attache case for containing business papers and the like, the invention essentially provides two pieces of luggage which can be manually transported with the use of only one hand when combined into an assembled configuration and which can be separated for individual use, such as use of the attache case for business purposes.

5 Claims, 3 Drawing Figures

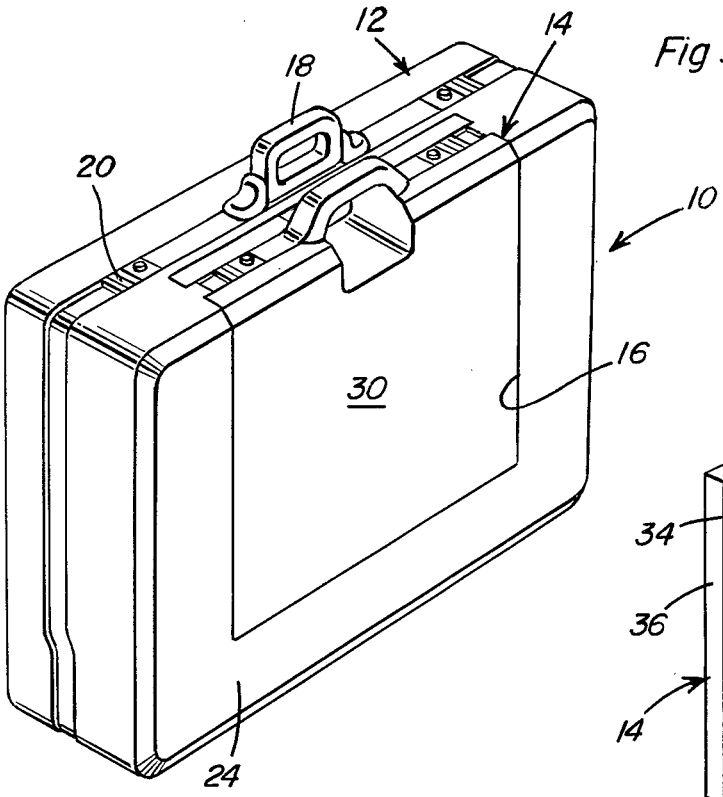
Fig. 1
Fig. 2
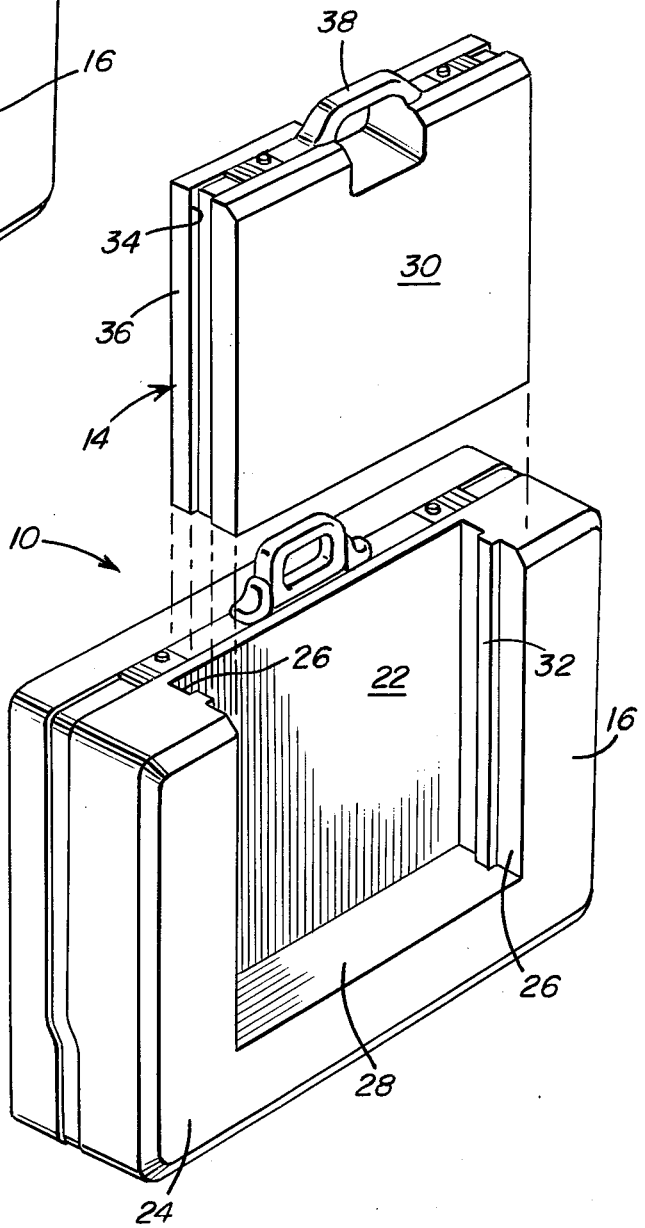
Fig. 3
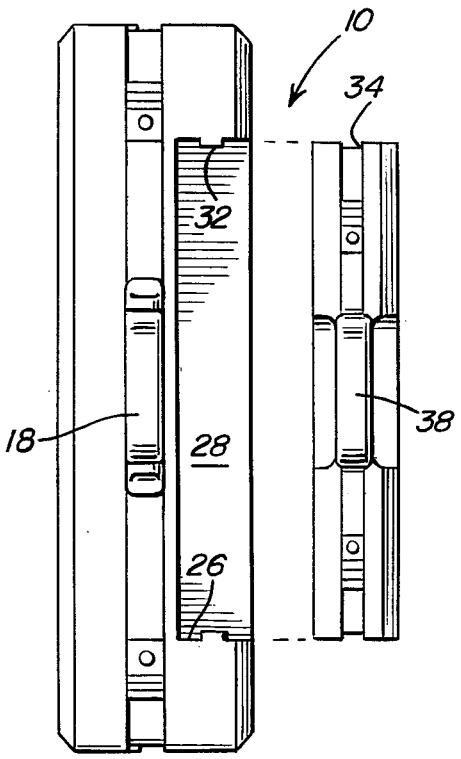

COMBINED SUITCASE AND BRIEFCASE

BACKGROUND OF THE INVENTION

1. Field of the Invention

The invention relates generally to container structures, such as are used for containing personal articles, business papers, and the like, and particularly to separate articles of luggage which can be interconnected for convenient portability and separable for individual use.

2. Description of the Prior Art

The prior art has previously provided varying structures comprised of separable containers which are detachably connected by fastening apparatus, the prior structures typically providing two separate containers positioned in lateral or superimposed relation to each other with the peripheral walls of one container being disposed externally of the peripheral walls of the other container. Further, the prior art has also provided a container assembly comprised of a gasoline can provided with a recess in a peripheral wall thereof, a smaller second container being received within the recess to enable convenient portability of the two containers.

The prior art has not provided a container structure suitable for use on a short business trip of between one and three days duration. In such a travel situation, at least two pieces of luggage are typically required, an attache case or a briefcase for containing business papers, samples, and the like, and a full-size suitcase for containing personal articles of clothing, and the like. Since business travel usual involves the use of public transportation including travel by air, by train, and the like, the necessity for manual handling of two such pieces of luggage requires the use of both hands, thereby presenting problems to the user of such luggage when entering or exiting buildings or vehicles. Therefore, a need exists for the combined luggage structure of the present invention, said combined structure being comprised of a full-size suitcase for containing personal articles and which has a recessed portion formed in a peripheral side wall for receiving an attache case therein. The combined structure essentially occupies the same volume as that occupied by a normal full-sized suitcase, the combined structure being portable and readily carried with one hand.

SUMMARY OF THE INVENTION

The invention provides a full-size travelling case, typically referred to as a suitcase and used for containing personal articles such as clothing, the suitcase having a recess formed in a peripheral side wall adapted to receive an attache case therein. When the attache case is disposed within the recess in the suitcase, the assembly takes a generally rectangular form, a peripheral side wall of the attache case forming a portion of the peripheral wall of the assembly. Therefore, the assembled configuration of the two pieces of luggage occupies substantially the same volume as does the full-size suitcase. The suitcase portion of the present combination has sufficient volume internally thereof to contain the necessary articles of clothing and other personal items typically used during a short trip, only a relatively small portion of one lateral section of the suitcase being rendered unusable for storage within the suitcase by virtue of the indentation caused by the recess in one of the peripheral side walls of said suitcase. An attache case of full volumetric dimensions is disposed within the recess formed in the suitcase, the attache case being slidable into the recess along guide rails preferably disposed on spaced opposite walls of the recess. The attache case is preferably provided with recessed channels formed in spaced minor side walls thereof, ridge-like tracks located in the recess in the suitcase being received into the channels formed in the attache case to guide the attache case into the recess and to hold the attache case therein against movement of the attache case laterally of major side wall portions of the suitcase.

The combined luggage structure of the invention can be conveniently carried in the manner of a typical full-size suitcase, the two luggage pieces of the invention when combined thereby being adapted to be carried through the use of only one hand. When the combined luggage assembly of the invention is to be checked, such as at an airport, or the like, the attache case portion of the assembly can be readily slid from the recess and taken with the user of the assembly, if desired. When the user of the assembly is domiciled in temporary quarters, such as in a hotel, the suitcase portion of the assembly remains in the temporary quarters while the attache case is conveniently removable therefrom to be used in a normal business fashion. It is also to be understood that the attache case portion of the present luggage assembly can be used independently while the suitcase portion of the assembly is stored when not in use.

Accordingly, it is an object of the present invention to provide a combined luggage structure comprised of at least two pieces of luggage including a suitcase for containment of personal articles and an attache case for containment of business papers, and the like, the attache case being receivable within an external recess formed in a peripheral side wall of the suitcase, the combination being portable as a single unit.

It is another object of the present invention to provide a full-size suitcase having an external recess formed therein for receiving a full-size attache case thereinto, mating track structure formed within the interior of the recess and externally of the attache case allowing convenient and controlled reception of the attache case into the recess.

It is a further object of the present invention to provide a combined luggage structure wherein an attache case is receivable within an external recess formed in a full-size suitcase, mating track structure formed in the recess and on the attache case retaining the attache case within the recess against lateral displacement of the attache case from the recess.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view illustrating the combined luggage structure of the invention and particularly showing an attache case received within an external recess formed in a suitcase;

FIG. 2 is an assembly view in perspective of the present combined luggage structure, the manner in which the attache case fits into the recess formed in the suitcase being shown; and, FIG. 3 is a plan view of the present combined luggage structure in a disassembled configuration.

DESCRIPTION OF THE PREFERRED EMBODIMENTS

Referring to the drawings and particularly to FIGS. 1 and 2, the combined luggage structure is seen at 10 to comprise a full-size suitcase 12 and an attache case 14, the attache case 14 being received into a recess 16 formed in the suitcase 12. The structure 10 thus formed can be seen to be conveniently handled as if the two pieces of luggage were a single full-size suitcase structure. The suitcase 12 can be seen to comprise a container structure of substantially standard dimensions, the suitcase 12 having a handle 8 adapted to be manually gripped and suitable for carrying either the suitcase 12 alone or the combined luggage structure 10 of the invention. The suitcase 12 is further formed with standard latches, such as the latches 20, which allow the substantially rectangular solid structure to be operable with hinges (not shown) to provide a travelling case for containing personal articles such as clothing, and the like, in a known manner. The suitcase 12 is particularly provided with a recessed lateral wall 22 spaced inwardly of one peripheral major side wall 24 of said suitcase 12. The recessed lateral wall 22, along with oppositely spaced recessed side walls 26 and a recessed bottom wall 28 define the recess 16, planar surface portions of the recessed side walls 26 and the recessed bottom wall 28 being substantially perpendicular to the plane of the recessed lateral wall 22. The recess 16 is thereby defined and is of a volumetric dimension suitable for receiving the attache case 14 thereinto, a peripheral major side wall 30 of the attache case 14 forming in combination with the peripheral major side wall 24 of the suitcase 12 a major side wall portion of the combined luggage structure 10. In other words, when the attache case 14 is fully received within the recess 16 in the suitcase 12, the exposed side wall 30 of the attache case 14 forms a continuation of the side wall 24 of the suitcase 12, thereby presenting a substantially unbroken surface laterally of the combined luggage structure 10.

As can also be seen in FIG. 3, a ridge-like track member 32 is seen to be longitudinally disposed along each of the recessed side walls 26, the track members 32 being aligned and oppositely facing each other. Recessed channels 34 dimensioned to mate with the track members 32 are formed in minor side walls 36 of the attache case 14, the track members 32 being receivable within the recessed channels 34 to allow the attache case 14 to be inserted into the recess 16 from the side thereof opposite the recessed bottom wall 28. When the attache case 14 is fully inserted into the recess 16, the minor side walls 36 of said case 14 fit substantially flushly against the recessed side walls 26 of the suitcase 12 while lower portions of the attache case 14 abut and fit flushly against the recessed bottom wall 28. Handle 38 of the attache case 14 therefore extends externally of the recess 16 to allow the attache case 14 to be grasped and removed from the recess 16.

In use, the combined luggage structure 10 of the invention can be conveniently carried by means of the handle 18, the entire structure 10 being readily transported through the use of only one hand.

It is to be understood that the structure 10 can be configured other than as shown explicitly in the drawings. For example, the ridge-like track member 32 could alternatively be formed on the minor side walls 36 of the attach case 14, the recessed channels 34 then being formed in such a situation in the recessed side wall 26 of the suitcase 12. However, since the recessed channels 34 can conveniently be formed in the attache case 14 immediately of the minor side walls 36 along the lines whereby the attache case 14 is normally opened, it is preferred that the recessed channels 34 be formed in the attache case 14. Further, by forming the ridge-like track members 32 in the recessed side walls 26 of the suitcase 12 rather than forming the recessed channels 34 therein, additional interior space within the suitcase 12 is conserved. It is further to be understood that the track members 32 need not be continuous to enable aligned reception of the attache case 14 within the recess 16.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A container assembly comprising first and second container elements, wherein: said first container element has a first peripheral wall with a portion thereof defining a recess adapted to accept the second container element therein and form a firm releasable engagement therewith; said second container element being relatively smaller than said first container element and having a first substantially planar peripheral wall which is coplanar with a portion of said first container element first peripheral wall when said second container is disposed in said recess, thereby forming a container assembly first continuous peripheral wall composed of said portion of said first container first peripheral wall and said second container first substantially planar peripheral wall.

2. The assembly as defined in claim 1 and further wherein said first container element has a second peripheral wall, transverse to said first peripheral wall with a portion thereof further defining said recess; said second container element having a second substantially planar eral wall which is transverse to said first substantially planar peripheral wall and which is coplanar with a portion of said first container element second peripheral wall when said second container element is disposed in said recess thereby forming a container assembly second peripheral wall which is transverse to said container assembly first peripheral wall.

3. The assembly as defined in claim 1 wherein said second container has dimensions substantially the same as the recess thereby giving the container assembly the appearance of a single unitary construction.

4. The assembly as defined in claim 3 and further wherein said first container element has a handle thereon disposed centrally of one peripheral wall of said container assembly so as to distribute the weight of said container assembly evenly about said handle in order to facilitate the carrying of the container assembly by the handle, said handle being firmly affixed to said first cointainer element.

5. The container assembly of claim 4 and further wherein said second container element has a handle disposed centrally on one side thereof to facilitate the carrying of said second container element when separated from said container assembly.

* * * * *